US010738440B2

(12) United States Patent
Gately

(10) Patent No.: US 10,738,440 B2
(45) Date of Patent: Aug. 11, 2020

(54) PIPE LAYING APPARATUS

(71) Applicant: Pearse Gately, Sallins (IE)

(72) Inventor: Pearse Gately, Sallins (IE)

( * ) Notice: Subject to any disclaimer, the term of this patent is extended or adjusted under 35 U.S.C. 154(b) by 0 days.

(21) Appl. No.: 16/064,540

(22) PCT Filed: Dec. 22, 2016

(86) PCT No.: PCT/EP2016/082437
§ 371 (c)(1),
(2) Date: Jun. 21, 2018

(87) PCT Pub. No.: WO2017/109105
PCT Pub. Date: Jun. 29, 2017

(65) Prior Publication Data

US 2018/0371721 A1 Dec. 27, 2018

(30) Foreign Application Priority Data

Dec. 22, 2015 (GB) ..... 1522663.2

(51) Int. Cl.

| | |
|---|---|
| ***E02F 5/00*** | (2006.01) |
| ***E02F 5/10*** | (2006.01) |
| ***E02F 3/36*** | (2006.01) |
| ***E02F 3/96*** | (2006.01) |
| ***E02F 5/12*** | (2006.01) |
| ***E02F 5/22*** | (2006.01) |

(52) U.S. Cl.
CPC ..... *E02F 5/10* (2013.01); *E02F 3/3609* (2013.01); *E02F 3/962* (2013.01); *E02F 3/967* (2013.01); *E02F 5/12* (2013.01); *E02F 5/223* (2013.01)

(58) Field of Classification Search
CPC . E02F 5/10; E02F 3/3609; E02F 3/962; E02F 3/967; E02F 5/12; E02F 5/223
See application file for complete search history.

(56) References Cited

U.S. PATENT DOCUMENTS

| | | | | | |
|---|---|---|---|---|---|
| 1,877,974 | A | * | 9/1932 | Robb | F16L 1/038 254/134.3 R |
| 2,748,750 | A | * | 6/1956 | Altschuler | E02D 3/068 173/162.1 |
| 3,207,326 | A | * | 9/1965 | Enix | F16L 1/09 254/29 R |
| 3,923,412 | A | * | 12/1975 | Linz | E02D 3/068 404/133.05 |
| 4,127,351 | A | * | 11/1978 | Vural | E02D 3/02 404/133.05 |

(Continued)

FOREIGN PATENT DOCUMENTS

| | | |
|---|---|---|
| CA | 1242081 A | 9/1988 |
| EP | 1016761 A1 | 7/2000 |

(Continued)

OTHER PUBLICATIONS

ISA/EPO, "International Search Report and Written Opinion of the International Searching Authority," International Application No. PCT/EP2016/082437, dated Apr. 7, 2017, 14 pages.

*Primary Examiner* — Benjamin F Fiorello

(57) ABSTRACT

The present invention relates to an apparatus for laying a pipe in a trench, the apparatus comprising a placement assembly (2) for placing the pipe in the trench; a compactor mechanism (3) for compacting of the aggregate about the pipe.

7 Claims, 9 Drawing Sheets

(56) References Cited

U.S. PATENT DOCUMENTS

| | | | | | |
|---|---|---|---|---|---|
| 4,280,770 | A * | 7/1981 | Woodruff | E02D 3/054 | 404/133.2 |
| 4,362,435 | A * | 12/1982 | Henry | F16L 1/036 | 294/103.1 |
| 4,382,715 | A * | 5/1983 | Vural | E02D 3/046 | 404/117 |
| 4,397,590 | A * | 8/1983 | Friesen | E02D 17/12 | 405/154.1 |
| 4,480,942 | A * | 11/1984 | Farrow | F16L 1/036 | 294/67.2 |
| 4,570,553 | A * | 2/1986 | Ito | A01B 79/00 | 111/118 |
| 4,735,523 | A * | 4/1988 | Ishikawa | E02D 3/074 | 212/349 |
| 6,280,119 | B1 * | 8/2001 | Ryan | B66C 1/425 | 294/104 |
| 6,418,644 | B1 * | 7/2002 | Bykov | E02F 3/967 | 37/142.5 |
| 9,073,732 | B2 * | 7/2015 | LaValley | B66C 1/44 | |
| 2007/0292211 | A1 | 12/2007 | Mitchell | | |
| 2014/0037378 | A1 | 2/2014 | Wilson | | |

FOREIGN PATENT DOCUMENTS

| | | | |
|---|---|---|---|
| JP | H09189044 | A | 7/1997 |
| JP | 2002364019 | A | 12/2002 |
| WO | 2010126983 | A1 | 11/2010 |
| WO | 2013166559 | A1 | 11/2013 |

* cited by examiner

PIPE LAYING APPARATUS

CROSS-REFERENCE TO RELATED APPLICATION

The present application is a United States nationalization under 35 U.S.C. § 371 of International Patent Application No. PCT/EP2016/082437, filed 22 Dec. 2016, which claims priority to Great Britain Patent Application No. 1522663.2, filed 22 Dec. 2015, and which is incorporated herein by reference for all purposes.

FIELD OF THE INVENTION

The present invention relates to an apparatus for laying a pipe in a trench and in particular to the laying and subsequent covering of the pipe.

BACKGROUND TO THE INVENTION

In conventional practice, pipe laying comprises the steps of excavating a trench and reinforcing the structural integrity of the trench by fitting a trench box therein. The floor of the trench may then be leveled with aggregate, for example gravel, or other suitable material. A pipe is subsequently lowered into the trench, whereupon labourers disposed within the trench manipulate the lowered pipe so as to engage the pipe with previously laid pipe sections. The remainder of the trench is infilled to completely cover the laid pipe.

Principal amongst the difficulties associated with the traditional pipe laying techniques is that trench work is extremely hazardous. The threat of injury or death to workers resulting from trench cave-ins is a recurrent possibility. Moreover, the costs associated with enacting protective measures to prevent workers in the trenches from being trapped or seriously injured in the event of trench wall collapse are considerable.

A summary of current best practice for the laying of pipes is as follows: a trench is dug to a depth of circa 150 mm below the design bottom level of the pipe to allow for the placement of a layer of crushed stone pipe bedding material beneath the pipe. A steel protection box is placed in the trench to prevent the trench walls collapsing on the workers.

A crushed stone bedding material is then poured into the trench using an excavator or other means and the workers in the trench then manipulate this material to form the bedding layer for the pipe.

Great care must be taken to ensure that the top level of this bedding material is accurately aligned with the designed pipe gradient and the designed bottom level of the pipe and this is commonly achieved by measuring from an in pipe laser beam which is pre aligned to the pipe line and gradient.

The pipe is then lowered into the trench and the workers insert this pipe into a previously laid pipe and carefully adjust the pipe so as it is correctly aligned along the design line and gradient.

Additional crushed stone is then lowered into the trench and the workers place this stone either side and along the length of the pipe up to the halfway level on the pipe diameter.

This side fill stone is manipulated with a shovel or rod by inserting the tool into the gravel along both sides of the pipe thus ensuring that any voids that may exist within the stone are replaced with stone.

This is a key facet of the installation as the pipe relies on this stone to provide structural support to the pipe in the bedding and haunch zones, the bedding zone been the area underneath the pipe and the haunch zone being the area at either side of the pipe up to a level halfway up the circumference of the pipe to a level known as the springline. Improperly supported pipes may move or dislodge during and after infilling of the trench leading to additional excavation or realignment of pipes which adds considerable time and expense to the pipe laying process.

There remains a need for alternative devices capable of minimising human intervention in placing materials in a trench, thereby reducing the potential for injury resulting from trench collapse. Moreover, the device should be capable of setting a pipe secured therein to a specific slope or gradient and further provide for automated delivery and compaction of additional aggregate material such as crushed stone along either side and along the length of the pipe to ensure proper support of the laid pipe without requiring workers to operate in the trench in the manner described above.

SUMMARY OF THE INVENTION

According to an aspect of the present invention, there is provided a system for pipe laying comprising: a placement assembly for placing the pipe in a trench; a compactor mechanism for compacting of aggregate material about the pipe; the placement assembly and the compactor mechanism being integrated into a quick hitch coupler attachable to a dipper arm of a vehicle.

This is advantageous as the need to provide a separate attachment for the compactor mechanism and the placement assembly is obviated. Rather, the placement assembly and the compactor mechanism are integrated into a quick hitch coupler attachable to a dipper arm of a vehicle. As such, the system provides the advantage that buckets or other attachments may be readily attached or detached from the dipper arm of the excavator for use in conjunction with the placement assembly and the compactor mechanism.

A further advantage is that a system is provided for both the placement of a pipe in a trench and the subsequent delivery and compaction of aggregate material about the pipe. This greatly increases the efficiency of the pipe laying process meaning that a given length of piping may be laid in considerably reduced time compared to laying of the pipe and manual compaction of aggregate by workers operating in the trench. It also results in a much safer process as workers are not required to be in the trench to carry out the pipe installation. The compactor mechanism operates to ensure that no voids are left beneath the pipe in the bedding area which is sometimes a problem with manual compaction. Furthermore, compaction is provided about the haunch of the pipe. In this manner, a reliably compacted bed and haunch layer is provided to support the pipe without the intervention of workers in the trench.

The placement assembly may be integrated into a first quick hitch coupler attachable to a dipper arm of a first vehicle and the compactor mechanism may be integrated into a second quick hitch coupler attachable to a dipper arm of a second vehicle.

This provides a great degree of flexibility to the operator as each of the placement assembly and compactor assembly may be maneuvered and operated independently.

The compactor mechanism may comprise at least one pair of powered compacting elements, the compacting elements moveable along the length of a placed pipe for compacting of the aggregate about the bed and sides of the pipe along the length of the pipe. The compactor mechanism may be moveable along the length of the pipe at a predetermined speed for compacting of the aggregate about the bed and sides of the pipe along the length of the pipe.

The compacting elements may be submergible beneath the aggregate material. This is advantageous as it provides for effective simultaneous compaction of the aggregate material along with filling of the void beneath the pipe being laid.

This is advantageous as it provides that aggregate may be compacted to a pre-defined minimum density along the full length of a pipe being laid to achieve pipe bed and pipe haunch support. The density required for a given pipe type may be calculated prior to pipe laying and the compactor mechanism may be suitably calibrated to ensure such a density is achieved.

The speed of movement of the compactor mechanism along the length of the pipe may be adjustable. The speed of movement of the compactor mechanism along the length of the pipe is adjustable to different speeds calibrated to ensure the required compaction density about a number of different pipe sizes.

Adjusting the speed allows for optimal compaction for a given pipe diameter to be achieved. For example, when being compacted, aggregate has further to travel about the surface of a pipe of wider circumference than about the surface of a narrower circumference. As such, it is advantageous for the compactor mechanism to move more slowly along the length of a pipe of wider circumference compared to a pipe of narrower circumference. The speed of movement of the compactor mechanism along the length of the pipe may adjustable to a first speed in metres per second which would be suitable for compaction about a pipe with a first diameter. The speed of movement of the compactor mechanism along the length of the pipe may adjustable to a second speed in metres per second which would be suitable for compaction about a pipe with a second diameter. The speed may be set to one of a series of predetermined set points suitable for a particular pipe diameter.

The compacting mechanism may comprise at least one pair of compacting elements wherein the compacting elements are configured such that with a pipe in a trench, the first of a pair of compacting elements may be about a first side of the pipe length and the second of a pair compacting elements may be about an opposite side of the pipe length. Such a configuration is advantageous as it provides for compaction of aggregate along both sides of the pipe being laid. Furthermore, it provides than compaction may be performed simultaneously about both sides of the pipe. Simultaneous compaction about both sides in this manner ensures regularity of compaction and ensures that even and balanced support is provided by the compacted aggregate, especially about the bed and haunch area of the pipe. More than one pair of compacting elements may also be provided thus providing a series of compacting elements along each side of a pipe in a trench.

The compacting elements may comprise elongate members extendable along their length. The elongate members may be hingeable at least one point along their length. The separation between the first and second compacting elements of a pair may be adjustable. This provides for the compacting elements to be suitable for use with a wide variety of pipe widths.

The compacting elements may be moveable in a reciprocating motion for compacting of the aggregate about the pipe. The reciprocating motion provides a series of strikes or blows from the compacting elements to the aggregate. The compacting elements may have a stroke reciprocating distance of about 50 mm.

The frequency of the reciprocating motion may be adjustable wherein the frequency of the reciprocating motion is adjustable between a first frequency in strikes per minute which provides optimum compaction about a pipe of a first diameter and a second frequency in strikes per minute which provides optimum compaction about a pipe of a second diameter. This is advantageous as it provides that the frequency of the reciprocating motion may be set to correspond to a predetermined movement of the compactor mechanism along the pipe for optimal compaction of aggregate material for a particular pipe diameter.

The compacting elements are moveable from a first position when not in use for compacting to a second position when in use for compacting. The compacting elements are moveable from the first position wherein the elements are substantially parallel to a pipe in the trench to the second position wherein the elements are substantially perpendicular to a pipe in the trench. This is advantageous as it provides that the elements are folded away when not in use for compacting. When the pipe has been placed in the trench, the compacting elements may then move to the second position wherein the elements are substantially perpendicular to a pipe in the trench and the compacting action may begin.

The placement assembly may comprise an extendible elongate member wherein the member is extendible into the hollow of a pipe for holding and placement of the pipe in a trench. Providing an extendible member in this manner allows for full retraction of the elongate member from the pipe hollow once pipe installation is complete, thereby avoiding contact between the pipe and the elongate member. In addition, providing an extendible member in this manner allows for more delicate placement of a pipe in a trench compared to, for example, gripping a pipe about its outer circumference. Furthermore, damage to the pipe exterior is avoided.

The elongate member may be extendible by means of a hydraulic cylinder. This provides for accurate control over the extension and retraction of the elongate member from the hollow of the pipe.

The placement assembly may comprise an extendible member attached to the elongate member for urging an open end of a first pipe into a socket end of a second pipe. The extendible member may further comprise a flat surface or plate on the extendible member for engaging the end of a pipe and for urging or pushing the pipe into a desired position.

The placement assembly may further comprise an alignment means for alignment of the pipe in trench. The alignment means may comprise a target which may be coupled to the elongate member and a camera coupled to the elongate member for viewing of the target. In a further embodiment, the alignment means may comprise a target and a viewing camera positioned towards the front of the placement assembly and beneath the elongate member.

In a further embodiment, the alignment means may comprise a target attached to the quick hitch coupler for aiding alignment with an alignment beam; and a camera coupled to a housing of the elongate member for viewing of the target.

The target may be a "bullseye" type target. This is advantageous as the target allows for the centre of a pipe to be accurately aligned with the centre of a previously laid pipe by viewing when an in pipe laser beam (located in a guide pipe laid in the trench) coincides with the target within the elongate member. This ensures that connected pipes are correctly aligned to each other.

The alignment means may further comprise a beam emitting means, such as a laser, which may be coupled to the elongate member such that the laser is coupled atop the elongate member. The in pipe laser beam and target may be for alignment of the centre hollow of consecutive pipes being laid. The beam emitting means may be for alignment of the top collars of two consecutive pipes, with one of the consecutive pipes being in the trench. A combined in-pipe laser/target and beam emitting means is thus provided which allows for verification that both the near end and far end of a pipe are aligned with a previously laid pipe.

The compactor mechanism may be coupled to the placement assembly. This provides for a single combined mechanism for placement of pipes and subsequent compaction of aggregate material.

The apparatus may further comprise an aggregate delivery assembly for delivery of aggregate about the pipe in the trench. The aggregate delivery assembly may comprise a hopper for storage of aggregate material and a conveyor for transport of aggregate material from the hopper to a trench. This provides a significant time saving benefit as aggregate material may be placed about the pipe in significant volumes as soon as the pipe has been placed in the trench. In addition, no additional labour or external machinery is required to place the aggregate material. A further advantage is that the aggregate material may be delivered about the pipe at sufficient speed such that it is delivered along the length of the pipe. The speed of the conveyor may be adjustable. Furthermore, the aggregate material may be delivered in sufficient volume to fill about both sides of the pipe simultaneously.

The aggregate delivery assembly further comprises a mounting frame for attachment of the aggregate delivery assembly to a vehicle. This is advantageous as it provides that the aggregate delivery assembly may be readily retrofitted to a suitable vehicle, for example an excavator type vehicle.

The placement assembly and a compactor mechanism are attachable to a dipper arm of a vehicle. This is advantageous as it provides that the placement assembly and a compactor mechanism can be readily retro-fitted to a suitable vehicle, for example an excavator type vehicle. A placement assembly may be attached to one vehicle and a compactor mechanism may be attached to a second vehicle.

In a further aspect there is provided a system for pipe laying comprising: a placement assembly for placing the pipe in a trench; an aggregate delivery assembly for delivery of aggregate about the pipe in the trench; a compactor mechanism for compacting of aggregate material about the pipe.

According to an aspect of the present invention, there is provided an apparatus for laying a pipe in a trench, the apparatus comprising: a placement assembly for placing the pipe in the trench; a compactor mechanism for compacting of aggregate material about the pipe; such that the compactor mechanism is coupled to the placement assembly.

A compactor mechanism for compacting of aggregate material about the pipe is provided, wherein the compactor mechanism may comprise at least one pair of powered compacting elements, the compacting elements moveable along the length of a placed pipe for compacting of the aggregate about the bed and sides of the pipe along the length of the pipe.

The compacting elements may be submergible beneath the aggregate material.

The compactor mechanism may be integrated into a quick hitch coupler.

A placement assembly for placing a pipe in a trench is provided comprising an extendible elongate member wherein the member is extendible into the hollow of a pipe for holding and placement of the pipe in a trench.

The placement assembly may be integrated into a quick hitch coupler.

In a further aspect there is provided a method of laying a pipe in a trench comprising: placing a pipe in the trench using a placement assembly; delivering aggregate material about the pipe; compacting the aggregate material using a compactor mechanism wherein the compacting mechanism provides an automated reciprocating action for compaction of the aggregate material about the bed and the sides of the pipe.

DETAILED DESCRIPTION OF THE DRAWINGS

Figure 1A:
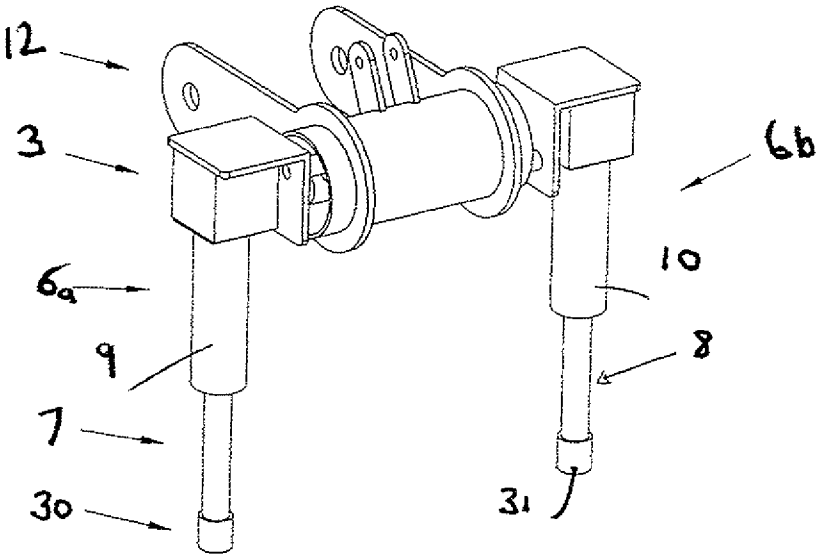
FIG. 1A is a schematic representation of the compactor mechanism of the system for pipe laying

FIG. 1A is a schematic representation of the compactor mechanism 3 of the system for pipe laying of the invention. The compactor mechanism comprises a pair of compacting elements 6*a*, 6*b*. The compacting elements are configured as a pair of piston rods 7, 8, each within a housing and moveable within the housings 9, 10. The rods 7, 8 perform a reciprocating action, such that the heads 30, 31 of the rods strike or blow aggregate material, such as gravel, which has been placed about the pipe. The reciprocating action may be hydraulically powered or alternatively may be pneumatically powered. The reciprocating action may be electrically powered. As described further below in relation to the operation of the system, the heads 30, 31 and/or the rods 7, 8 may be submerged in the aggregate material while the reciprocating action is performed. Submerging the rods in this manner provides for very effective compaction about the sides and beneath the pipe being laid.

Figure 1B:
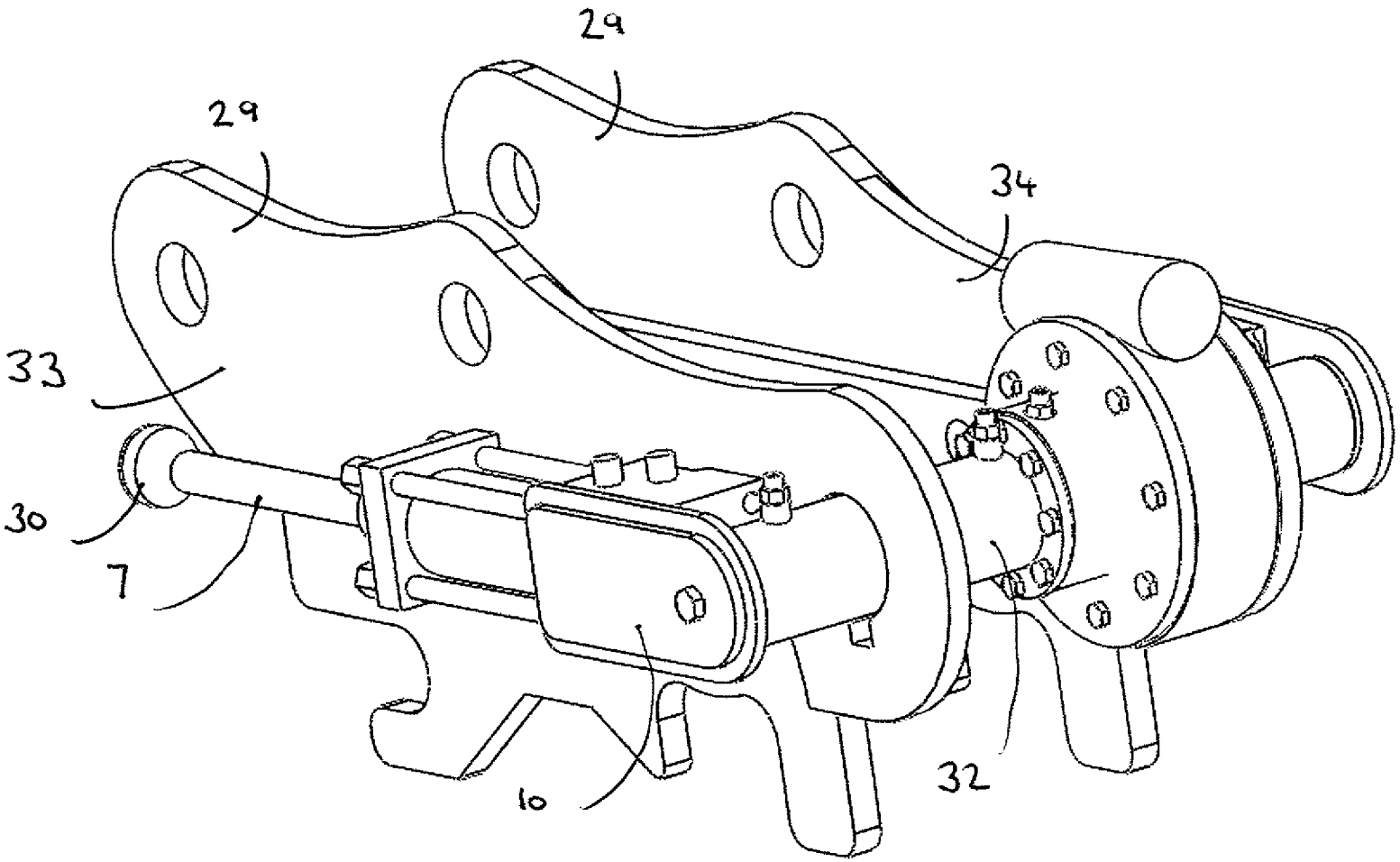
FIG. 1B and FIG. 1C show an embodiment of the compactor mechanism integrated into a quick hitch coupler
Figure 1C:
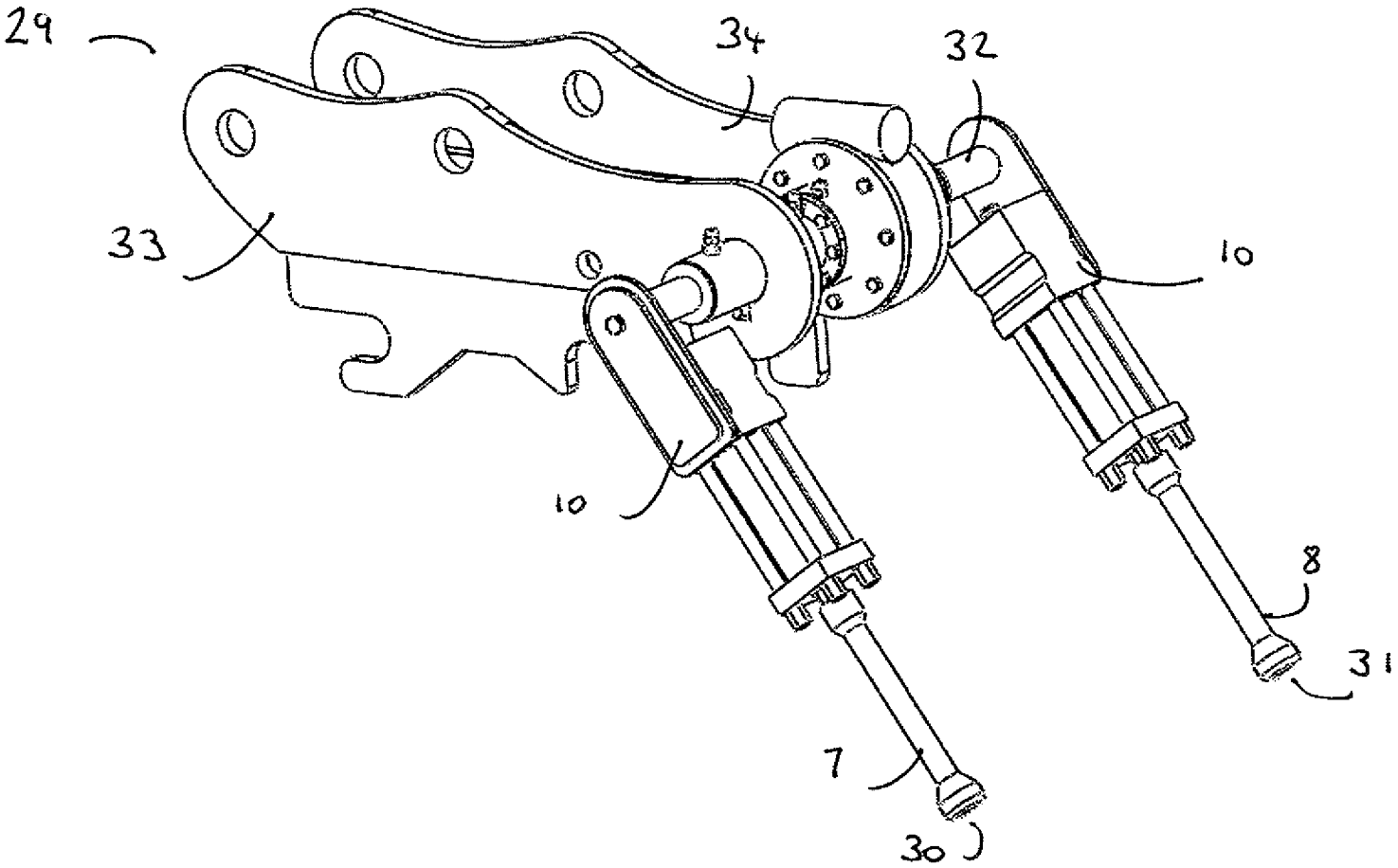

FIG. 1B and FIG. 1C show an embodiment of the compactor mechanism 3 of the system such that the compactor mechanism is integrated into a quick hitch coupler 29 for a dipper arm of an excavator. The compactor mechanism is integrated into the coupler such that one of the pair of compacting elements is about one side of the coupler and the second of the pair of compacting elements is about the other side of the coupler. A connecting element 32 through the side plates 33, 34 of the coupler connects the pair of compacting elements. FIG. 1B shows the configuration in which the compacting elements extend along the side plates of the coupler. The compacting elements are not in use for compacting when in this configuration. The compacting elements are moveable from the position shown in FIG. 1B to the position shown in FIG. 1C. FIG. 1C shows the configuration in which the compacting are extend away at an oblique angle to the side plates 33, 34 of the coupler and thus, in use, would be at an oblique angle to the a vehicle dipper arm to which the coupler is attached. The compacting elements may also be at an angle substantially perpendicular to the side plates of the coupler 29 when in use for compacting.

The compacting elements are configured such that with a pipe in a trench, the first 6*a* of the pair of compacting elements is about a first side of the pipe length and the second 6*b* of the pair of compacting elements is about an opposite side of the pipe length. As such, the pipe is positioned between the rods. The frequency of the reciprocating motion is adjustable. The frequency of the reciprocating motion is adjustable through controls coupled to the compacting elements which allow for the motion of the elements to be pre-set for an appropriate frequency for a given pipe diameter. For example, the frequency is adjustable between a first frequency in strikes per minute which provides optimum compaction about a wide diameter pipe and a second frequency in strikes per minute which provides optimum compaction about a narrower diameter pipe.

The compacting elements are moveable from a first position wherein the elements extend along the side plates 33, 34 of the coupler to a second position wherein the elements extend away from the side plates 33, 34 of the coupler. The compacting elements are rotatable about a bracket 12. In a further embodiment, the compacting elements may have an additional hinging element about the upper end of the housings 9, 10 such that the housings are hingeable inwards towards the base of a pipe. With the rods hinged in this manner, additional compaction about the base of the pipe and the bed area is possible. In particular, effective compaction is found when the compactors are submerged into the gravel while the reciprocation motion of the compactors is performed.

In an embodiment of the invention, a cylindrical compactor comprising a compactor head of about 50 mm diameter is found to be advantageous for compaction. Furthermore, a 50 mm stroke reciprocating distance for the compactor is found to be advantageous.

In a particular embodiment, good compaction is achieved with:

a compactor head diameter of about 50 mm.

a reciprocating stroke length of about 50 mm.

Furthermore, effective compaction is found when the compactor heads are placed at all times below the surface of the gravel when the reciprocating compacting action is taking place. This is found to allow gravel from above to continuously fall into the void just below the head 30, 31 created with each blow of the head 30, 31.

In summary, once a pipes gravel bedding and surrounding side gravel has been placed, it becomes necessary to both push this gravel entirely under the pipe and simultaneously compact the material. It has been found to be effective to submerge the compactor heads into the gravel bedding. To allow a compactor to effectively be inserted into the gravel bed in this manner, a cylindrical compactor comprising a head of about 50 mm diameter is provided. Movement of such a compactor in a reciprocating motion beneath the surface of the gravel with a piston stoke length of about 50 mm effects the urging of the gravel entirely under the pipe and also has the effect of simultaneously compacting gravel in the area surrounding the pipe.

In should be noted that typical compactors comprising a flat "plate on top of gravel" only provide compaction to a certain depth circa. 200 mm. Furthermore, such compactors are not capable of pushing gravel under a pipe. In addition, such compactors are not submergible in the gravel, they are merely capable of pushing down onto the top the surface of the gravel. The present invention provides for both pushing the gravel traversely from both sides in order to fill the void under the pipe but also provides for simultaneous compacting of the gravel.

Figure 4:
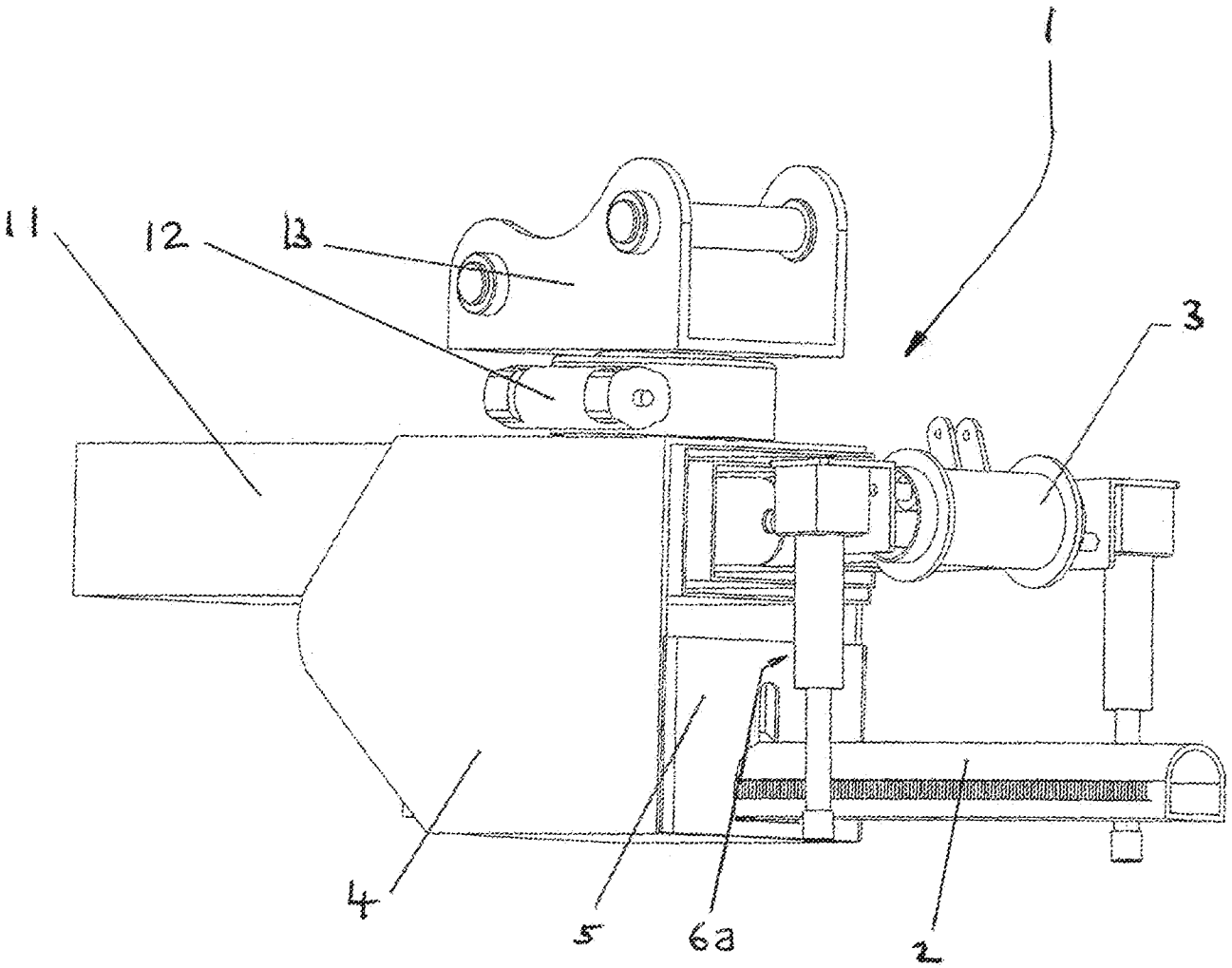
FIG. 4 is a schematic representation of an embodiment of the pipe laying system

The placement assembly and compactor mechanism is connectable to the end of an excavator dipper arm at bracket 13 (FIG. 4). The bracket may be a quick hitch coupling bracket or a quick hitch coupler. Furthermore, as described, the placement assembly and compactor mechanism may be integrated into the quick hitch coupling bracket or a quick hitch coupler. A quick hitch coupler on an excavator is a latching device that enables attachments to be connected to the dipper arm of the excavator and changed rapidly and with minimum manpower effort. As such, the system of the present invention may be used with quick hitch couplers without preventing normal use of the coupler for attachment/detachment of buckets and other attachments. In an embodiment of the invention, a placement assembly is connected to one excavator and a compactor assembly is connected to a second excavator. In this embodiment, the placement assembly and the compactor assembly may be operated independently of each other.

Figure 2A:
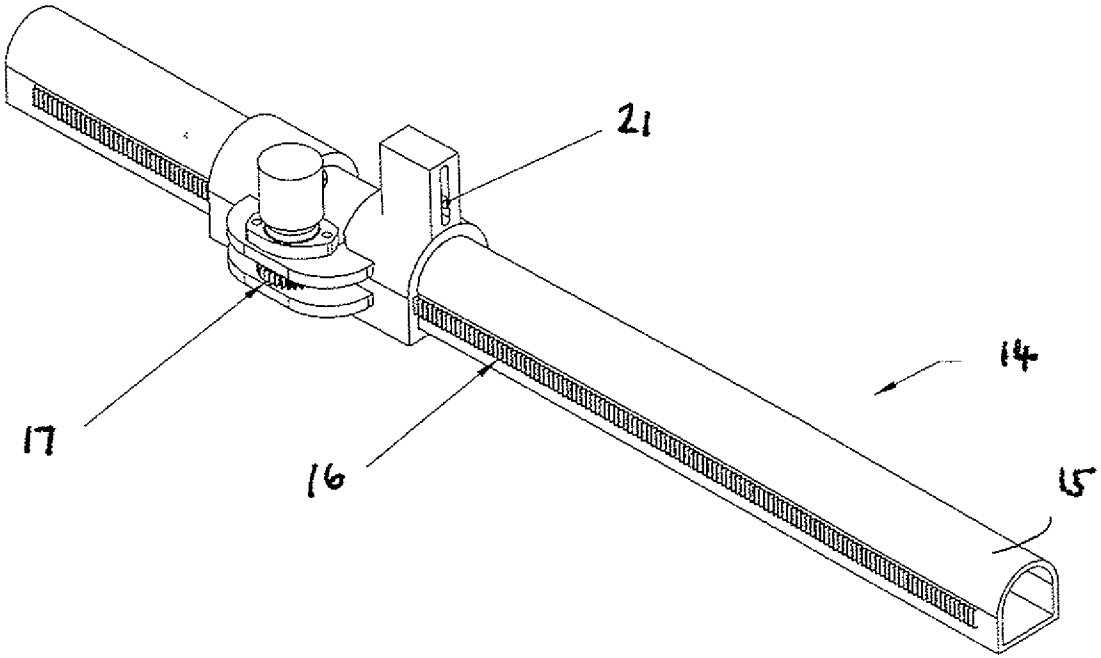
FIG. 2A is a schematic representation of the placement assembly of the system for pipe laying
Figure 3:
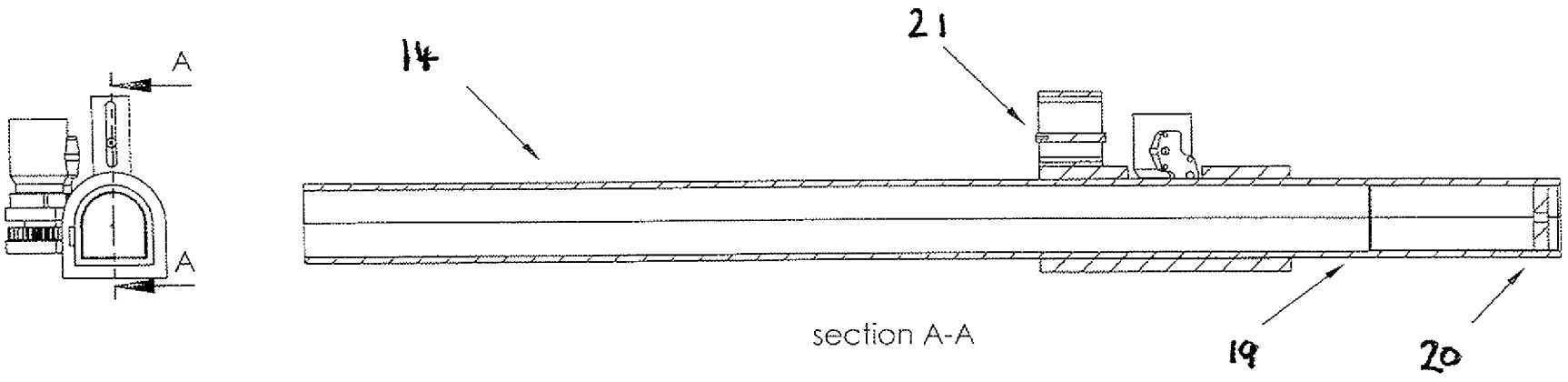
FIG. 3 is a cross section representation of the extendible mechanism of the placement assembly

FIG. 2A is a schematic representation of an embodiment of the placement assembly 2 of the system comprising an extendible mechanism 14. FIG. 3 is a cross sectional representation of the extendible mechanism 14 of the placement assembly 2. The extendible mechanism comprises an elongate member 15. The member is extendible into the hollow of a pipe for holding and placement of the pipe in a trench. The elongate member 15 is extendible by means of a rack 16 and pinion 17 gear arrangement. The rack gear 16 runs substantially along the length of the elongate member. The pinion gear 17 mechanism is coupled to the rack gear of the elongate member and resides within the housing.

The placement assembly further comprises an alignment means 18 for alignment of the pipe in trench. The alignment means comprises a bullseye target 19 coupled to the elongate member wherein the target is housed within the elongate member. In a given pipeline construction, the first pipe to be laid may be termed a guide pipe and contains an in pipe laser which emits a beam of laser light through the centre of the hollow of the pipe. This in pipe laser, which is set to shine along a predetermined design line and gradient, may serve as a guide to ensure that subsequent laid pipes are properly aligned with the pre-determined line and gradient of the initial guide pipe.

The target is thus used for alignment of a pipe being placed with the in pipe laser from the guide pipe. The elongate member is hollow with one open end and one closed end. The target 19 is fixed to the closed end of the elongate member such that laser light from the in pipe laser may shine internally along the length of the elongate member. A camera 20 is further coupled to the closed end of elongate member to provide a visual guidance for alignment of the bullseye of the target 19 with the beam from the in-pipe laser. A laser 21 is coupled to the top outer surface of the elongate member. While the in pipe laser beam and target 19 serve for alignment of the centre hollow of consecutive pipes being laid, the laser 21 serves for alignment of the top collars of two consecutive pipes, with one of the consecutive pipes being in the trench. A pipe being laid may be considered to be in alignment with the previously laid pipe, once the in pipe laser beam is aligned with the target 19 of the elongate member and the laser 21 of the elongate member is aligned with the top collar of the previously laid pipe.

Figure 2B:
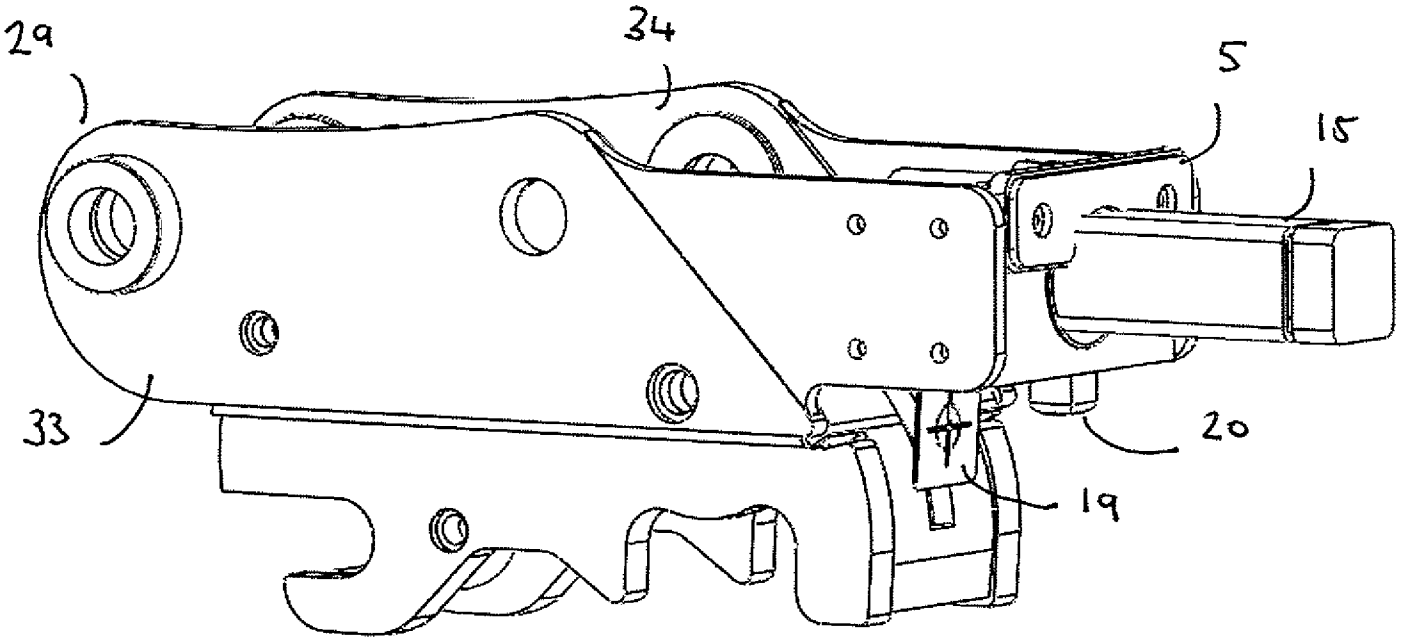
FIG. 2B and FIG. 2C show an additional embodiment of the placement assembly integrated into a quick hitch coupler
Figure 2C:
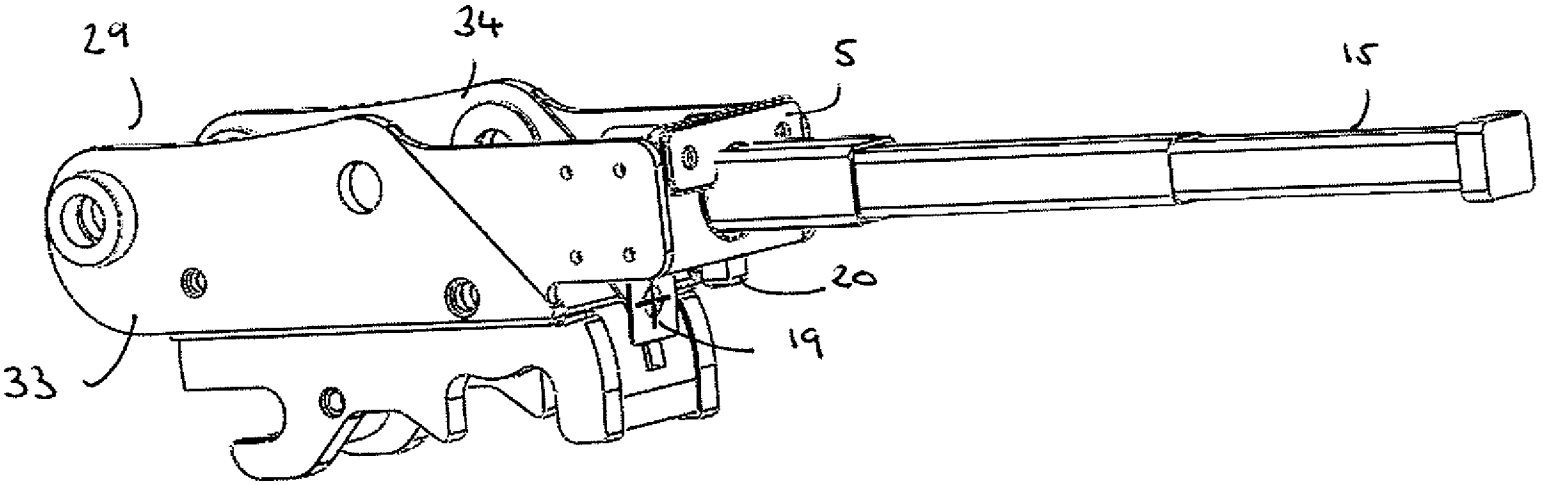

FIG. 2B and FIG. 2C show an embodiment of the placement assembly of the system such that the placement assembly is integrated into a quick hitch coupler 29 for a dipper arm of an excavator. In this embodiment, the laser bullseye target 19 is at the front of the pipe placement assembly and the camera 20 is to the front of and above the target 19. The camera is coupled to a housing of the elongate member. In FIG. 2B, the elongate member 15 is in a retracted position such that it is ready for extension into the hollow of a pipe. In FIG. 2C, the elongate member 15 is in an extended position such that a pipe may be retained by the member when the member is extended within the hollow of a pipe. In this embodiment, the elongate member may be extendible by a hydraulic cylinder rather than a rack and pinion gear arrangement. A push connect plate 5 is extendible outwards to push a second pipe end into the socket of a first pipe.

FIG. 4 is a schematic representation of an embodiment the pipe laying system 1 of the invention. The apparatus comprises a placement assembly 2 and compactor mechanism 3. The compactor mechanism 3 is coupled to the placement assembly 2 and both the compactor mechanism 3 and the placement assembly 2 reside in a single housing 4. In the arrangement shown, the compactor mechanism is positioned above the placement assembly. A push connect plate 5 is extendible outwards to push a second pipe end into the socket of a first pipe. In the arrangement shown, the compactor mechanism is moveable via a telescopic arm 11. The compactor mechanism is moveable at a predetermined speed along the length of a pipe for compacting of the aggregate about the length of the pipe. The compactor mechanism comprises a bracket 12 for attachment to the telescopic arm 11. The speed of movement of the compactor mechanism along the length of the pipe is adjustable by adjustment of the extension and retraction speed of the telescopic arm 11.

Figure 5:
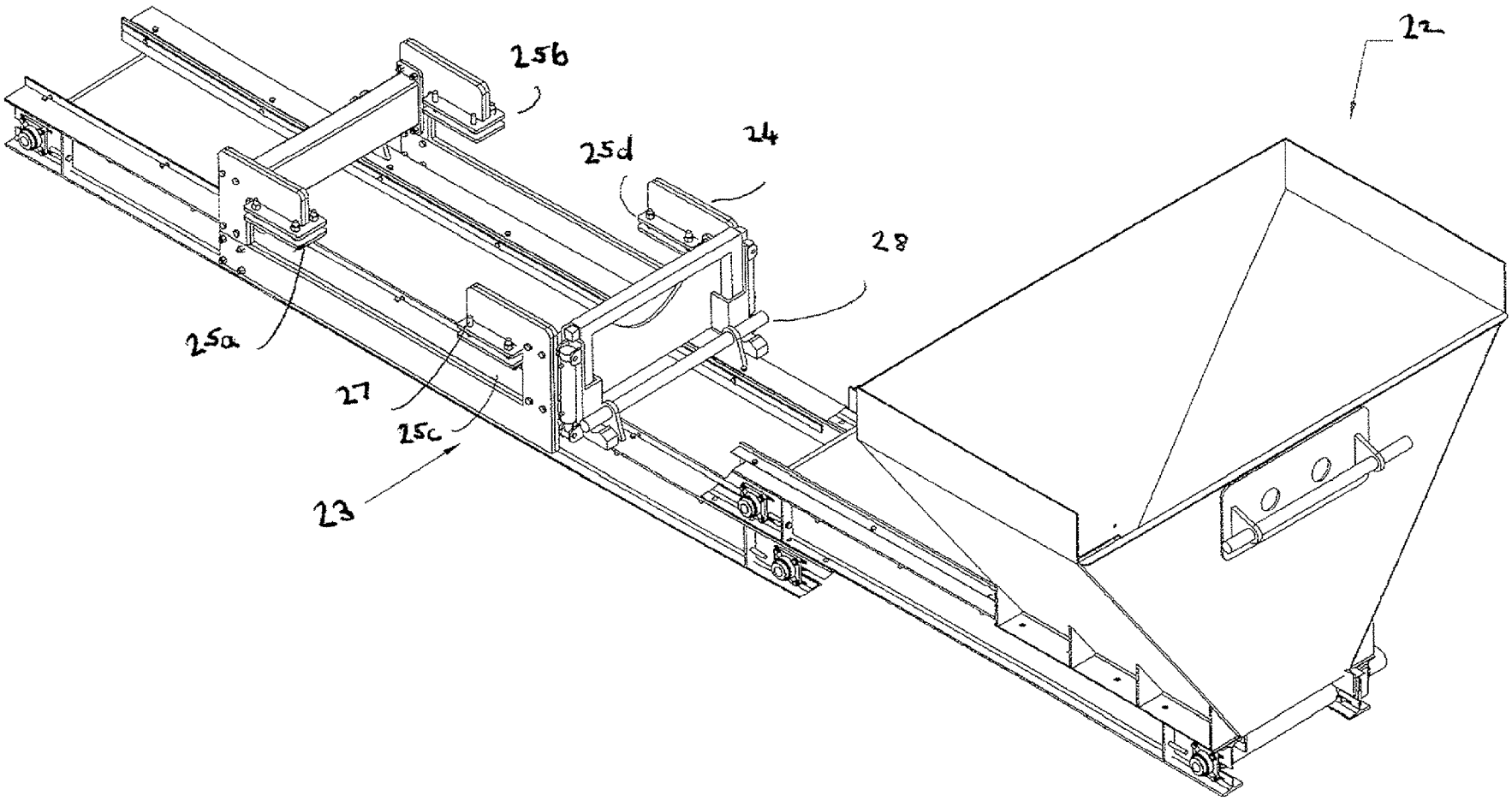
FIG. 5 is a schematic representation of the aggregate delivery assembly

FIG. 5 is a schematic representation of an embodiment of the invention comprising an aggregate delivery assembly. The aggregate delivery assembly comprises a hopper 22 for storage of aggregate material and a conveyor 23 for transport of aggregate material from the hopper to a trench. The speed of the conveyor 23 is adjustable so that an optimum speed of aggregate material delivery for a given pipe width may be achieved. The speed of delivery and the volume of aggregate should be sufficient that the aggregate material can quickly fill both sides along the length of a pipe. The aggregate delivery assembly further comprises a mounting frame 24. A clamp section 25 is used to attach the mounting frame 24 of the aggregate delivery assembly to a vehicle, for example to a typical excavator vehicle. The clamp section comprises four clamps 25*a*, 25*b*, 25*c* and 25*d*. The four clamps are for attachment to the undercarriage of the vehicle. The aggregate delivery assembly thus is connected to the excavator undercarriage frame by first attaching mounting frame 24 via the clamps 25*a*, 25*b*, 25*c* and 25*d* to the excavator undercarriage and securing each of the clamps in place with a number of attaching members 27, for example with bolts. Similarly, the mounting frame may be detached from a vehicle by removing the bolts 27 and thus de-clamping the frame from the vehicle. With the mounting frame 24 clamped in place, the conveyor 23 may be attached to the mounting frame. The conveyor is slotted beneath the mounting frame and is secured to the frame with pin 28. The hopper 22 is then connected to one end of the conveyor such that aggregate material fed into the hopper 22 is transferred from the hopper to the conveyor 23.

Apparatus in Use

In use, the apparatus functions as follows: An excavator dipper arm is fitted with a compacting mechanism integrated into a quick hitch coupler as described with respect to FIGS. 1B and 1C and a second excavator dipper arm is fitted with a placement assembly integrated into a quick hitch coupler as described with respect to FIGS. 2B and 2C. Alternatively, the placement assembly and compactor mechanism are connected to the end of an excavator dipper arm via the coupler bracket 13. The aggregate delivery assembly is connected as described above to the excavator undercarriage frame by first attaching mounting frame 24 to the excavator undercarriage and clamping it thereon using clamps 25*a*, 25*b*, 25*c* and 25*d* and then inserting pin 28 to retain the conveyor and hopper. Alternatively, gravel may be placed around the pipe using a bucket connected to the excavator comprising the compacting mechanism.

A trench is excavated to a depth of circa 150 mm below the design bottom level of the pipe to be laid. A first guide pipe having an in pipe laser as described above is then placed in the trench to the desired design depth and gradient.

Typically, the excavators will be maneuvered such that their tracks or wheels straddle the open trench, with one set of tracks or wheels on one side of the trench and the opposing set of tracks or wheels on the other side of the trench such that the placement assembly, compactor mechanism and the conveyor of the aggregate delivery assembly are substantially in-line with the trench.

Using the excavator controls, the elongate member 15 is inserted into the end of the next pipe to be laid. The member is extended beyond halfway along the pipe length using a hydraulic cylinder. The pipe is then lowered into the trench using the excavator controls.

The far end (i.e. end farthest the excavator) of the pipe is offered up to the socket end of the guide pipe (or a subsequently laid pipe). Using the laser 21 as a guide and by observing when this laser beam strikes the top of the guide pipe, it is then known that the far end of the pipe is aligned with the guide pipe. The pipe is then partly inserted into the guide pipe.

Using the excavator controls and a viewing feed from the camera 20, the near end (i.e. the end nearest the excavator) of the pipe is then moved laterally and vertically until the in pipe laser line from the guide pipe coincides with the bullseye target as viewed by the camera 20. The pipe is now aligned along the in pipe laser line and is then pushed into the previously laid pipe using the push connect plate 5 to complete the pipe to pipe connection.

With the pipe still held in aligned position by the elongate member 15, aggregate material such as crushed stone bedding is then discharged from the hopper 22 via discharge conveyor 23 onto and along the top centre line of the pipe. Alternatively, aggregate is discharged into an excavator bucket for placement along the pipe. The aggregate material falls down the sides and underneath the pipe, thus providing partial fill of the pipe bed and haunch zones. The aggregate material is ejected at sufficient speed from the discharge conveyor 23 into the trench such that it is delivered along the length of the pipe and not just at the point where the conveyor overhangs the trench. Furthermore, the aggregate material is delivered in sufficient volume that upon striking the top centre line of the pipe, it is subsequently directed by the curved top surface of the pipe into the trench about both sides of the pipe simultaneously. As set out above, alternatively gravel may be placed around the pipe using a bucket connected to the excavator comprising the compacting mechanism.

The compactor mechanism 3 is then activated. The reciprocating compactors 6*a*, 6*b* are orientated into a perpendicular position relative to the pipe bed and positioned such that they are submerged beneath the aggregate material surface. The reciprocating compactors 6*a*, 6*b* are then moved along the entire length and both sides of the pipe. The compactors 6*a*, 6*b* produce a reciprocating motion to blow or strike the aggregate material thereby simultaneously pushing the stone aggregate material under the pipe from both sides in addition to compacting the aggregate material. This forms a suitable compacted bed and haunch layer for the pipe which is at the required level for alignment with the guide pipe. The reciprocating motion compacts the aggregate material at the sides and under the pipe at the same time thus providing a reliably compacted bedding and haunch layer and sufficient support about the pipe sides to prevent settlement or subsequent lateral movement of the pipe. The elongate member 15 is extracted from the pipe and using the excavator controls and the pipe laying apparatus is maneuvered away from the freshly laid pipe. The pipe installation is now complete and the process may begin again with a further pipe. The above is described in relation to a pipe being laid subsequent to the guide pipe. The same process is followed for each subsequent pipe to be laid.

Testing up to pipe diameters of 600 mm has been performed using the above apparatus as described. It has been evidenced that once the above process had been followed and when the pipe was thereafter removed, the bedding stone was compacted entirely around the lower half circumference of the pipe. Furthermore when the bedding stone was removed, it was observed that the stone was embedded into the bottom and the sides of the trench. This demonstrated that high levels of pipe support and bedding compaction were achieved by the mechanism.

The words "comprises/comprising" and the words "having/including" when used herein with reference to the present invention are used to specify the presence of stated features, integers, steps or components but do not preclude the presence or addition of one or more other features, integers, steps, components or groups thereof. It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A compactor mechanism for compacting of aggregate material about a pipe in a trench, the pipe having a predetermined pipe gradient, wherein the compactor mechanism comprises at least one pair of powered compacting elements, the compacting elements being configured to be moveable in a reciprocating motion along the length of a placed pipe for simultaneously compacting the aggregate to a pre-defined minimum density about the bed and sides of the pipe along the length of the pipe to maintain the pipe gradient.

2. The compactor mechanism of claim 1 wherein the compacting elements are submerged beneath the aggregate material at all times when compacting the aggregate.

3. The compactor mechanism of claim 1, the compactor mechanism being integrated into a quick hitch coupler.

4. The compactor mechanism of claim 1, wherein the compacting elements are elongate elements.

5. The compactor mechanism of claim 1, wherein the compacting elements have stroke reciprocating distance of about 50 mm.

6. The compactor mechanism of claim 1, wherein the frequency of the reciprocating motion is adjustable.

7. The compactor mechanism of claim 1 wherein the frequency of the reciprocating motion is adjustable between a first frequency in strikes per minute which provides optimum compaction about a pipe of a first diameter and a second frequency in strikes per minute which provides optimum compaction about a pipe of a second diameter.

* * * * *